US005733386A

United States Patent [19]

Yoshida et al.

[11] Patent Number: 5,733,386

[45] Date of Patent: Mar. 31, 1998

[54] POLYMER COMPOSITION AND METHOD FOR TREATING METAL SURFACES

[75] Inventors: Masayuki Yoshida; Shigeo Tanaka, both of Yokohama; Kazutomo Miyafuji, Osaka-fu, all of Japan

[73] Assignee: Henkel Corporation, Plymouth Meeting, Pa.

[21] Appl. No.: 722,097

[22] PCT Filed: Apr. 14, 1995

[86] PCT No.: PCT/US95/04435

§ 371 Date: Oct. 15, 1996

§ 102(e) Date: Oct. 15, 1996

[87] PCT Pub. No.: WO95/28449

PCT Pub. Date: Oct. 26, 1995

[30] Foreign Application Priority Data

Apr. 15, 1994 [JP] Japan ..... 6-077209

[51] Int. Cl.[6] ..... C23C 22/00; C23F 11/10

[52] U.S. Cl. ..... 148/251; 148/259; 148/260; 106/14.15; 106/14.12; 106/14.21

[58] Field of Search ..... 148/251, 259, 148/260; 106/14.15, 14.12, 14.21

[56] References Cited

U.S. PATENT DOCUMENTS

| | | | |
|---|---|---|---|
| 4,963,596 | 10/1990 | Lindert et al. | 526/313 |
| 4,970,264 | 11/1990 | Lindert et al. | 525/328.8 |
| 5,039,770 | 8/1991 | Lindert et al. | 526/312 |
| 5,063,089 | 11/1991 | Lindert et al. | 427/354 |
| 5,068,299 | 11/1991 | Lindert et al. | 526/313 |
| 5,116,912 | 5/1992 | Lindert et al. | 525/340 |
| 5,246,507 | 9/1993 | Kodama et al. | 148/250 |
| 5,266,410 | 11/1993 | Lindert et al. | 526/313 |
| 5,370,909 | 12/1994 | Tanaka et al. | 427/388.4 |

FOREIGN PATENT DOCUMENTS 61-091369 5/1986 Japan .

*Primary Examiner*—Sam Silverberg

*Attorney, Agent, or Firm*—Ernest G. Szoke; Wayne C. Jaeschke; Norvell E. Wisdom, Jr.

[57] ABSTRACT

A highly corrosion-resistant, paint-adherent, and lubricating polymer-containing coating on a metal surface can be formed by contact with an aqueous solution (pH=2.0 to 6.5) that contains an acidic compound and polymer with the following formula (I):

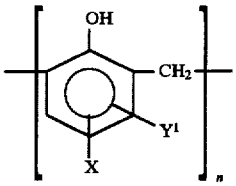

(I)

in which the X bonded to the phenyl ring in formula (I) represents a hydrogen atom, a hydroxyl group, a $C_1$ to $C_5$ alkyl group, a $C_1$ to $C_5$ hydroxyalkyl group, a $C_6$ to $C_{12}$ aryl group, a benzil group, a benzal group, an unsaturated hydrocarbon moiety condensed to the phenyl ring so as to form a naphthalene ring, or a group corresponding to formula (II):

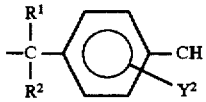

(II)

in which $R^1$ and $R^2$ in formula (II) each independently represent a hydrogen atom, a hydroxyl group, a $C_1$ to $C_{10}$ alkyl group, or a $C_1$ to $C_{10}$ hydroxyalkyl group; the $Y^1$ and $Y^2$ bonded to the phenyl ring in formulas (I) and (II) each independently represents a hydrogen atom or a group Z according to one of formulas (III) and (IV):

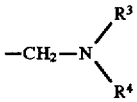

(III)

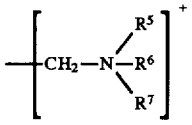

(IV)

in which each of $R^3$, $R^4$, $R^5$, $R^6$, and $R^7$ in formulas (III) and (IV) independently represents a $C_1$ to $C_{10}$ alkyl group or a $C_1$ to $C_{10}$ hydroxyalkyl group; the X's bonded to the phenyl rings in the polymer molecule may all be identical or may differ from one another, each of the $Y^1$'s and $Y^2$'s bonded to the phenyl rings in the polymer molecule may all be identical or may differ from one another, the average value for the number of Z groups substituted on each phenyl ring in said polymer molecule is 0.2 to 1.0; and n has a value of 2 to 50.

8 Claims, No Drawings

POLYMER COMPOSITION AND METHOD FOR TREATING METAL SURFACES

TECHNICAL FIELD

This invention relates to a novel polymer composition and method for treating metal surfaces for the purpose of imparting an excellent corrosion resistance, paint adherence, and lubricity to such surfaces prior to the painting or working thereof. This invention is applied with particularly good effect to the treatment of metals prior to their painting or working.

RELATED ART

Phosphating is often used to treat metals prior to painting. Phosphating is carried out by treating the metal surface with an acidic aqueous solution whose base components are phosphoric acid and metal ions. An increase in pH is generated at the interface when the metal surface is etched by the acid, and this causes the precipitation of phosphate crystals (zinc phosphate, iron phosphate, and the like) on the metal surface in the form of a coating. The corrosion resistance and paint adherence of metal surfaces are substantially improved by the presence of this phosphate coating. This metal surface treatment is in wide use even at present. However, while phosphating does yield an improved corrosion resistance and paint adherence, the films produced by this method do not by themselves afford acceptable improvements in lubricity.

As a result, the treatment of metals prior to working, and particularly prior to plastic working, generally consists of a process in which phosphating is combined with a lubrication treatment. When, for example, only oil lubrication is used in the severe working process of cold forging, seizure occurs rather readily due to the large metal-to-metal contact area. To counter this, the surface of the metal is first coated with a phosphate film and a solid lubricant, such as a soap (including metal soap) or molybdenum disulfide, is then applied in order to form a lubricating film in the upper region of the phosphate film. This prior art process is thus a two-step process. Given the strong contemporary demands for resource conservation, energy conservation, and simplification of production processes, it is desired to provide a surface treatment agent that can be applied in a one-step treatment and will still yield a better property package than the prior art process.

The use of water-soluble resins in metal surface treatments whose goal is to provide metal surfaces with cortesion resistance and paint adherence is described, for example, in Japanese Patent Application Laid Open [Kokai or Unexamined] Numbers Sho 61-91369 [91,369/1986] and Hei 1-172406 [172,406/1989], Hei 1-177379 [177,379/1989], Hei 1-177380 [177,380/1989], Hei 2-608 [608/1990], and Hei 2-609 [609/1990].

In these prior art methods the metal surface is treated with an aqueous solution containing the derivative of a polyhydric phenol compound. However, the formation of an acceptably stable coating on metal surfaces is highly problematic with these prior art methods, and they also do not provide a satisfactory performance (cortesion resistance). Japanese Patent Application Laid Open [Kokai or Unexamined] Number Hei 4-66671 [66,671/1992] describes an improvement to treatment methods that use polyhydric phenol derivatives, but even the application of this method does not result in an acceptable adherence by the treated metal surface for some paints.

Problems to be Solved by the Invention

The present invention seeks to solve the problems described above for the prior art. In specific terms, this invention introduces a polymer composition and method for treating metal surfaces that are able to impart thereto an excellent corrosion resistance, paint adherence, and lubricity.

SUMMARY OF THE INVENTION

It has been discovered that highly corrosion-resistant, paint-adherent, and lubricating films could be formed through the use of a polymer composition containing water-soluble polymer with a special chemical structure. It was found that these highly desirable coatings could be formed by treating the metal surface with a surface treatment bath comprising an acidic aqueous solution containing said polymer composition. The present invention was developed based on these discoveries.

The polymer composition according to the present invention for treating metal surfaces comprises, preferably consists essentially of, or more preferably consists of water, an acidic compound, and polymer molecules corresponding to the following general formula (I):

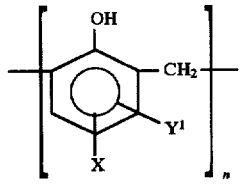

(I)

in which (i) the X bonded to the phenyl ring in formula (I) represents (i.1) a hydrogen atom, (i.2) a hydroxyl group, (i.3) a $C_1$ to $C_5$ alkyl group, (i.4) a $C_1$ to $C_5$ hydroxyalkyl group, (i.5) a $C_6$ to $C_{12}$ aryl group, (i.6) a benzil group, (i.7) a benzal group, (i.8) an unsaturated hydrocarbon moiety condensed to the phenyl ring so as to form a naphthalene ring, or (i.9) a group conforming to the following general formula (II):

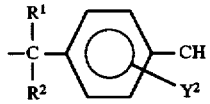

(II)

in which (i.9.1) each of $R^1$ and $R^2$ independently represents (i.9.1.1) a hydrogen atom, (i.9.1.2) a hydroxyl group, (i.9.1.3) a $C_1$ to $C_{10}$ alkyl group, or (i.9.4) a $C_1$ to $C_{10}$ hydroxyalkyl group; (ii) each of $Y^1$ and $Y^2$ independently represents (ii.1) a hydrogen atom or (ii.2) a group Z conforming to one of the following formulas (III) and (IV):

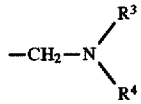

(III)

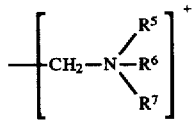

(IV)

in which each of $R^3$, $R^4$, $R^5$, $R^6$, and $R^7$ independently represents (ii.2.1) a $C_1$ to $C_{10}$ alkyl group or (ii.2.2) a $C_1$ to $C_{10}$ hydroxyalkyl group; (iii) the X's in the polymer molecule may all be identical or may differ from one another; (iv) the $Y^1$'s and $Y^2$'s in the polymer molecule may all be identical or may differ from one another; (v) the average value for the number of Z groups substituted on each phenyl ring in said polymer molecule is 0.2 to 1.0; and (vi) n has a value of 2 to 50.

The method according to the present invention for treating metal surfaces comprises contacting the surface of a metal with an aqueous treatment solution that contains the above-described polymer composition for treating metal surfaces.

The aqueous treatment solution used in the invention method preferably has a pH of 2.0 to 6.5 and preferably contains polymer (I) in a concentration of 0.01 to 20 g/L. The aqueous treatment solution used in the invention method also, independently, preferably contains 0.1 to 30 g/L of phosphate ions.

DETAILS OF PREFERRED EMBODIMENTS

The essential ingredients in a composition according to the present invention for treating metal surfaces are the water-soluble polymer with the specified chemical structure and an acidic compound.

The molecular weight of the polymer is normally too low when n is less than 2, resulting in an inadequate corrosion resistance of the ultimately obtained coating. The corresponding aqueous treatment solution normally is insufficiently stable when n exceeds 50, resulting in problems at the practical level.

The average value for the number of Z group substitutions is the average value of the number of Z groups introduced into each phenyl ring calculated over all the phenyl rings in the polymer molecule. As an example, when in formula (I) n is 10 and X takes the form of the phenyl ring-containing group (II), each polymer molecule will contain 20 phenyl rings. When one Z group has been introduced into each of 10 phenyl rings in this polymer molecule, the average value for the number of Z group substitutions in this polymer (hereinafter referred to as the average value for Z group substitution) is calculated as follows.

$$[(1\times10)+(0\times10)]/20=0.5$$

The polymer usually is insufficiently water soluble when the average value for Z group substitution is below 0.2; this results in a lower stability for the corresponding aqueous treatment solution and thus creates problems at the practical level. When, on the other hand, the average value for Z group substitution exceeds 1.0, the resulting polymer becomes very soluble in water. This can impede precipitation of the polymer from the aqueous treatment solution onto the metal surface, which in turn can prevent formation of an acceptable coating.

Each of the $R^3$ to $R^7$ on the groups Z defined by (III) and (IV) represents $C_1$ to $C_{10}$ alkyl groups and $C_1$ to $C_{10}$ hydroxyalkyl groups. The presence in these groups of 11 or more carbons causes the Z group to become bulky. As a consequence, the coating formed on the metal surface normally will then have a coarse structure and an inadequate corrosion resistance.

The type of acidic compound present in the polymer composition according to the present invention is not critical; however, this component is in general preferably selected from phosphoric acid, sulfuric acid, hydrochloric acid, hydrofluoric acid, condensed phosphoric acids, and the like. The content of subject acidic compound is also not narrowly restricted. Since the polymer composition generally occurs in the form of an acidic aqueous solution, the acidic compound is preferably added in an amount that can stably maintain this condition, for example, an amount that maintains the pH of the composition (aqueous solution) at 2.0 to 6.5.

In the method according to the present invention, a polymer-containing coating is produced on metal surfaces by contacting the metal surface with an aqueous treatment solution containing the above-described polymer composition. The polymer containing coating can then be fixed on the metal surface by rinsing the coating with water and drying by heating.

The preferred concentration of polymer (I) in the aqueous treatment solution in the invention method is 0.01 to 20 g/L. Concentrations below 0.01 g/L can prevent or impede the stable production of a coating on the metal surface. Concentrations in excess of 20 g/L raise the cost of the aqueous treatment solution to a point that can be economically undesirable.

The pH of the aqueous treatment solution is adjusted to 2.0 to 6.5 in the method according to the present invention. An excessive etch normally occurs when this pH falls below 2.0 and can impair formation of the coating. The polymer has a pronounced tendency to deposit or precipitate at a pH above 6.5, which can result in an abbreviated service life of the aqueous treatment solution. The pH of the aqueous treatment solution may be adjusted to the desired value using an acid, e.g., phosphoric acid, nitric acid, hydrochloric acid, hydrofluoric acid, condensed phosphoric acids, and so forth, or using alkali, e.g., sodium hydroxide, sodium carbonate, ammonium hydroxide, and so forth.

In an even more preferred embodiment, the pH of the aqueous treatment solution is adjusted by the addition of phosphate ion. Phosphoric acid ($H_3PO_4$), sodium phosphate ($Na_3PO_4$), and the like, can be used as the source of the phosphate ions. The phosphate ions content preferably ranges from 0.1 to 30 g/L and more preferably ranges from 0.5 to 10 g/L. The reactivity of the aqueous treatment solution is improved by the presence of the phosphate ion. In addition, when phosphate ions are present, phosphate salt(s)—formed from etched out metal and the phosphate ions in the bath—precipitate on the surface and enter into the coating. This results in an increased corrosion resistance under some circumstances. Phosphate ions concentrations below 0.1 g/L are too low to have much favorable effect. A good-quality coating is still formed at phosphate ions concentrations above 30 g/L, but the high cost of the aqueous treatment solution makes such concentrations economically disfavored.

When metal ions elute from the metal substrate and mix into the treatment bath, a precipitate may be produced in some cases due to the formation of a complex between the polymer and these metal ions. A metal ion sequestrant is preferably added to the treatment bath in such cases. Useable as this sequestrant are, for example, EDTA, Cy-DTA, tdethanolamine, gluconic acid, heptogluconic acid, oxalic acid, tartaric acid, malic acid, and organophosphonic acids, but the particular sequestrant selection is not critical.

Contact between the aqueous treatment solution and metal surface can be achieved in the invention method by immersion, spraying, and the like.

Problems can occur due to foaming by the aqueous treatment solution when a spray treatment is used. The generation of foam strongly depends on the conditions prevailing in the equipment, and a defoamer is preferably added to the aqueous treatment solution when a foaming problem cannot be satisfactorily resolved by changes in the equipment conditions. The nature of the defoamer is not critical, and any defoamer may be used which does not impair the paint adherence in a subsequent painting step.

One example of the preparation of the aqueous surface treatment solution of the present invention will now be briefly explained. In this example, preparation commences with dissolution of phosphate ions with thorough stirring in the prescribed amount of water as described above. When the pH of the resulting aqueous treatment solution exceeds 7, the pH of the aqueous treatment solution is adjusted to less than or equal to 7 using a suitable acid as described above. The water-soluble polymer (I) specified by the invention is then added while stirring and completely dissolved, and the pH is adjusted to 2.0 to 6.5 as described above.

The coating formed on the metal surface will now be briefly discussed. The coating formed by the aqueous surface treatment solution according to the present invention is an organic coating whose main component is polymer (I). Phosphate ions may be added in order to obtain even higher levels of corrosion resistance, in which case a polymer/phosphate organic-inorganic composite coating is produced.

The method according to the present invention for treating metal surfaces is discussed in general terms in the following. The treatment bath employed by the method of the present invention can be used according to any of various processes, of which the following are preferred examples.

Surface Treatment Process 1

(1) Surface cleaning: degreasing—an acidic, alkaline, or solvent-based degreaser may be used (2) Water rinse (3) Film-forming treatment (application of the treatment bath according to the present invention)
Treatment temperature: 15° C. to 90° C.
Treatment technique: immersion or spraying
Treatment time: 5 to 60 seconds (hereinafter usually abbreviated "sec")

(4) Water rinse (5) Rinse with de-ionized water (6) Drying: 60° C. to 250° C.×2 to 300 seconds.

Surface Treatment Process 2

(1) Surface cleaning: degreasing—an acidic, alkaline, or solvent-based degreaser may be used (2) Water rinse (3) Film-forming treatment (application of the treatment bath according to the present invention)
Treatment temperature: 15° C. to 90° C.
Treatment technique: immersion, spraying, or coating
Treatment time: up to 60 sec (4) Drying (as in process 1)

The aqueous surface treatment solution according to the present invention is preferably used at temperatures ranging from 15° C. to 90° C. The reactivity is normally inadequate and a good-quality coating is not formed when the treatment temperature falls below 15° C. Although good-quality coatings are formed at treatment temperatures above 90° C., the corresponding high energy costs for heating make such temperatures economically undesirable. Treatment times of 5 to 60 seconds are preferred when the coating is to be reactively fixed on the metal surface and the unreacted components are to be removed by a water rinse. The reaction often will be insufficient at treatment times below 5 sec; this interferes with the formation of a highly corrosion-resistant and strongly lubricating film. Treatment times in excess of 60 sec do not usually yield additional improvements in performance and therefore are economically disfavored. The post-treatment water rinse can be omitted, as in process 2. In this case, the preferred treatment time is simply less than or equal to 60 seconds and treatment can be run by immersion, spraying, or coating. Treatment times not exceeding 60 seconds are appropriate in this case since no additional improvement in performance is observed at treatment times in excess of 60 sec.

No specific limitations apply to metals that may be subjected to the method according to the present invention. The metal can be selected from the usual metals of commerce, for example, iron, steel, stainless steel, zinc-plated steel, tin-plated steel, aluminum, aluminum alloys, copper, magnesium, and the like. In addition to these metals, the method according to the present invention can be applied to the surface of metals on which a cleaning treatment or conversion treatment (e.g., phosphate, chromate, etc.) has already been executed. Various lubricants, for example, metal soaps, solid lubricants, oils, and so forth, may be coated over the surface of the metal after the treatment according to the present invention has been executed. In other words, the organic-inorganic coating formed by the method according to the present invention can be used as a carrier (support) for a variety of lubricants. Moreover, the polymer composition according to the present invention may contain a preservative or antimold agent (for example, hydrogen peroxide): this inhibits putrefaction or mold growth during storage of the surface treatment bath or its use at low temperatures.

Several working examples are provided below with regard to the surface treatment polymer composition and treatment method according to the present invention, whose effectiveness is made evident by comparison with the comparative examples. The individual surface treatment bath compositions and surface treatment methods are respectively described in the working and comparative examples.

EXAMPLES

1. Substrates (1) cold-rolled steel sheet (JIS C 3141 SPCC)

(2) tin-plated steel sheet (JIS G 3303 SPTE 2.8/2.8)

(3) aluminum sheet (JIS A5052)

(5) stainless steel sheet (JIS G 4305 SUS 304)

2. Evaluation Methods (1) Corrosion resistance test A

The surface-treated sheet (steel sheet) was held in air at 30° C. and 70% relative humidity for 5 days and then visually inspected for rust development. Rust development over a surface area less than 20% was rated as "excellent", while a rating of "poor" was assigned when rust development occurred over an area of 20% or larger.

(2) Corrosion resistance test B

The surface-treated sheet (tin-plated steel sheet) was heated at 180° C. for 30 minutes and the extent of surface discoloration (yellowing) was then evaluated. A rating of "excellent" was assigned when no discoloration was present, while a rating of "poor" was assigned when discoloration had occurred.

(3) Corrosion resistance test C

The surface-treated sheet (aluminum sheet) was immersed in boiling tap water for 30 minutes and the extent of discoloration (blackening) that developed during this test was evaluated. A rating of "excellent" was assigned when no discoloration was present, while a rating of "poor" was assigned when discoloration had occurred.

(4) Paint adherence test A

The surface-treated sheet (steel, tin-plated steel, and aluminum sheets) was painted with a commercial acrylic lacquer (paint film thickness=2 to 3 micrometers), and the painted sheet was then immersed in boiling de-ionized water for 1 hour. A peel test using commercial pressure-sensitive tape was thereafter executed on the specimen. A rating of "excellent" was assigned when no peeling occurred, while a rating of "poor" was assigned when peeling occurred.

(5) Paint adherence test B

The surface-treated sheet (aluminum sheet) was coated to a paint film thickness of 5 to 7 micrometers with an epoxy-urea paint. This was followed by baking for 4 minutes at 215° C. A 5×150 mm strip was then cut from the sample and hot-press bonded with polyamide film to give a test specimen. The film was subsequently peeled off in a 180° peel test, during which the peel strength was measured. Higher peel strength values in this test are indicative of a better paint adherence. Peel strength values equal to or greater than 4.0 kilograms-force (hereinafter usually abbreviated "kgf") per 5 millimeters (hereinafter usually abbreviated "mm") of width are generally regarded as excellent and were assigned a rating of "excellent".

(6) Lubrication test A

The static friction coefficient of the surface-treated sheet (steel, tin-plated steel, and aluminum sheets) was measured. Values for the static friction coefficient of less than or equal to 1.2 are generally regarded as excellent and were assigned a rating of "excellent".

(7) Lubrication test B

A calcium soap lubricant was coated on the sheet (stainless steel sheet) after the sheet had been subjected to the surface treatment. The lubrication was then measured using a Bowden friction wear tester. The test conditions were as follows: pressure element diameter=2 mm, load=5 kgf, temperature=ambient temperature, sliding velocity=10 mm/sec, and slide length=10 mm. The occurrence of seizure was presumed when the friction coefficient reached 0.4, and the number of slides required to reach that point was measured. A higher number of slides is indicative of better lubrication in this test. Fifty or more slides is generally regarded as excellent and was assigned a rating of "excellent".

EXAMPLE 1

Cleaned steel sheet was immersed for 2 seconds in surface treatment bath 1 with components given below, heated to 60° C. and then dried for 2 minutes in a hot air drying oven at 80° C. The treated sheet was subsequently submitted to corrosion resistance test A, paint adherence test A, and lubrication test A.

Surface Treatment Bath 1

| | | |
|---|---|---|
| 75% Phosphoric acid ($H_3PO_4$) | 1.0 g/L | ($PO_4^{-3}$ ion: 0.7 g/L) |
| Polymer 1 (see below) | 2.0 g/L | (solids) |

pH: 5.5 (adjusted with sodium hydroxide)

Balance: water.

Polymer 1: According to formula I when n=5, X=hydrogen, $Y^1$=Z=—$CH_2N(CH_3)$: and the average value for Z group substitution=1.0.

EXAMPLE 2

Cleaned steel sheet was immersed for 10 seconds in surface treatment bath 2 with components given below, heated to 30° C., and then dried for 2 minutes in a hot air drying oven at 80° C. The treated sheet was subsequently submitted to corrosion resistance test A, paint adherence test A, and lubrication test A.

Surface Treatment Bath 2

| | | |
|---|---|---|
| Hydrofluoric acid (HF) | 2 g/L | (F: 1.9 g/L) |
| Polymer 2 (see below) | 0.2 g/L | (solids) |

pH: 6.5 (adjusted with sodium hydroxide)

Balance: water

Polymer 2: According to formula I when n=5, X=—$CH_2$—$C_6H_4$—OH, $Y^1$=Z=—$CH_2N(CH_3)_2$ and the average value for Z group substitution=0.75.

EXAMPLE 3

Cleaned tin-plated steel sheet was immersed for 5 seconds in surface treatment bath 3 with components given below and heated to 60° C. This was followed by rinsing with tap water, spraying with deionized water (at least 3,000,000 ohm-cm) for 10 seconds, and drying for 2 minutes in a hot air drying oven at 180° C. The treated sheet was subsequently submitted to corrosion resistance tests A and B, paint adherence test A, and lubrication test A.

Surface Treatment Bath 3

| | | |
|---|---|---|
| 75% Phosphoric acid ($H_3PO_4$) | 10.0 g/L | ($PO_4^{-3}$ ion: 7.2 g/L) |
| Polymer 2 (same as in Example 2) | 10.0 g/L | (solids) |

pH: 3.0 (adjusted with sodium carbonate)

Balance: water.

EXAMPLE 4

Cleaned tin-plated steel sheet was sprayed for 30 seconds with surface treatment bath 4 with components given below and heated to 40° C. This was followed by rinsing with tap water, spraying with deionized water (at least 3,000,000 ohm-cm) for 10 seconds, and drying for 2 minutes in a hot air drying oven at 180° C., The treated sheet was subsequently submitted to corrosion resistance tests A and B, paint adherence test A, and lubrication test A.

Surface Treatment Bath 4

| | | |
|---|---|---|
| 75% Phosphoric acid ($H_3PO_4$) | 10.0 g/L | ($PO_4^{-3}$ ion: 7.2 g/L) |
| Polymer 3 (see below) | 10.0 g/L | (solids) |

pH: 3.0 (adjusted with sodium carbonate)

Balance: water.

Polymer 3: According to formula I when n=3, $Y^1$=Z =—$CH_2N(CH_3)_2$, X=—$C(CH_3)_2$—$C_6H_4$—OH, and the average value for Z group substitution=0.5.

EXAMPLE 5

Cleaned aluminum sheet was sprayed for 30 seconds with surface treatment bath 5 with components given below and heated to 40° C. This was followed by rinsing with tap water, spraying with aleionized water (at least 3,000,000 ohm-cm) for 10 seconds, and drying for 2 minutes in a hot air drying oven at 180° C. The treated sheet was subsequently submitted to corrosion resistance tests A, B, and C, paint adherence tests A and B, and lubrication test A.

Surface Treatment Bath 5

| | |
|---|---|
| 75% Phosphoric acid ($H_3PO_4$) | 5.0 g/L ($PO_4^{-3}$ ions: 3.6 g/L) |
| Polymer 4 (see below) | 10.0 g/L (solids) |

pH: 3.0 (adjusted with sodium tripolyphosphate)

Balance: water.

Polymer 4: According to formula I when n=3; $Y^1$=Z=—$CH_2N(CH_3)_2$, X=—$CH_2$—$C_6H_4$—OH, and the average value for Z group substitution=0.5.

EXAMPLE 6

Cleaned aluminum sheet was coated at 15° C. with surface treatment bath 6 with components given below and then dried for 2 minutes in a hot air drying oven at 80° C. The treated sheet was subsequently submitted to corrosion resistance tests A, B, and C, paint adherence tests A and B, and lubrication test A.

Surface Treatment Bath 6

| | |
|---|---|
| 75% Phosphoric acid ($H_3PO_4$) | 0.5 g/L ($PO_4^{-3}$ ions: 0.36 g/L) |
| Polymer 3 (same as in Example 4) | 1.0 g/L (solids) |

pH: 4.5 (adjusted with sodium pyrophosphate)

Balance: water.

EXAMPLE 7

Cleaned stainless steel sheet was immersed for 2 seconds in surface treatment bath 7 with components given below, heated to 60° C., and then dried for 2 minutes in a hot air drying oven at 80° C. The treated sheet was subsequently submitted to corrosion resistance tests A, B, and C, paint adherence test A, and lubrication tests A and B.

Surface Treatment Bath 7

| | |
|---|---|
| 75% Phosphoric acid ($H_3PO_4$) | 0.2 g/L ($PO_4^{-3}$ ions: 0.15 g/L) |
| Polymer 1 (same as in Example 1) | 2.0 g/L (solids) |

pH: 4.0 (adjusted with nitric acid)

Balance: water

EXAMPLE 8

Cleaned stainless steel sheet was immersed for 2 seconds in surface treatment bath 8 with components given below, heated to 90° C., and then dried for 2 minutes in a hot air drying oven at 80° C. The treated sheet was subsequently submitted to corrosion resistance tests A, B, and C, paint adherence test A, and lubrication tests A and B.

Surface Treatment Bath 8

| | |
|---|---|
| 75% Phosphoric acid ($H_3PO_4$) | 0.14 g/L ($PO_4^{-3}$ ions: 0.10 g/L) |
| Polymer 2 (same as in Example 2) | 0.5 g/L (solids) |

pH: 2.0 (adjusted with nitric acid)

Balance: water.

COMPARATIVE EXAMPLE 1

Cleaned steel sheet was immersed for 2 seconds in surface treatment bath 9 with components given below, heated to 60° C., and then dried for 2 minutes in a hot air drying oven at 80° C. The treated sheet was subsequently submitted to corrosion resistance test A, paint adherence test A, and lubrication test A.

Surface Treatment Bath 9

| | |
|---|---|
| 75% Phosphoric acid ($H_3PO_4$) | 1.0 g/L ($PO_4^{-3}$ ions: 0.7 g/L) |

pH: 5.5 (adjusted with sodium hydroxide)

Balance: water.

COMPARATIVE EXAMPLE 2

Cleaned tin-plated steel sheet was immersed for 5 seconds in surface treatment bath 10 with components given below, heated to 60° C. This was followed by rinsing with tap water, spraying with deionized water (at least 3,000,000 ohm-cm) for 10 seconds, and drying for 2 minutes in a hot air drying oven at 180° C. The treated sheet was subsequently submitted to corrosion resistance tests A and B, paint adherence test A, and lubrication test A.

Surface Treatment Bath 10

| | |
|---|---|
| 75% Phosphoric acid ($H_3PO_4$) | 10.0 g/L ($PO_4^{-3}$ ions: 7.2 g/L) |
| Polymer 2 (same as in Example 2) | 10.0 g/L (solids) |

pH: 8.0 (adjusted with sodium carbonate)

Balance: water.

COMPARATIVE EXAMPLE 3

Cleaned tin-plated steel sheet was immersed for 155 seconds in surface treatment bath 11 with components given below, heated to 60° C. This was followed by rinsing with tap water, spraying with deionized water (at least 3,000,000 ohm-cm) for 10 seconds, and drying for 2 minutes in a hot air drying oven at 180° C. The treated sheet was subsequently submitted to corrosion resistance tests A and B, paint adherence test A, and lubrication test A.

Surface Treatment Bath 11

| | |
|---|---|
| 75% Phosphoric acid ($H_3PO_4$) | 10.0 g/L ($PO_4^{-3}$ ions: 7.2 g/L) |
| Polymer 5 (see below) | 1.0 g/L (solids) |

pH: 8.0 (adjusted with sodium carbonate)

Balance: water

Polymer 5: polymer with formula (V) below, described in Japanese Patent Application Laid Open [Kokai or Unexamined] Number Hei 1-177380):

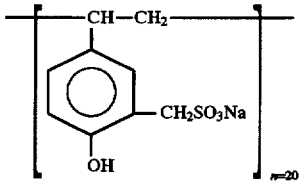

(V)

COMPARATIVE EXAMPLE 4

Cleaned aluminum sheet was sprayed for 30 seconds with a 2% aqueous solution of a commercial conversion treatment agent (ALODINE® 404, manufactured by Nihon Parkerizing Company, Limited), heated to 40° C. This was followed by rinsing with tap water, spraying with aleionized water (at least 3,000,000 ohm-cm) for 10 seconds, and drying for 2 minutes in a hot air drying oven at 180° C. The treated sheet was subsequently submitted to corrosion resistance tests A, B, and C, paint adherence tests A and B, and lubrication test A.

COMPARATIVE EXAMPLE 5

Cleaned aluminum sheet was sprayed for 30 seconds with surface treatment bath 12 with components given below, heated to 40° C. This was followed by rinsing with tap water, spraying with deionized water (at least 3,000,000 ohm-cm) for 10 seconds, and drying for 2 minutes in a hot air drying oven at 180° C. The treated sheet was subsequently submitted to corrosion resistance tests A, B, and C, paint adherence tests A and B, and lubrication test A.

Surface Treatment Bath 12

| | | |
|---|---|---|
| 75% phosphoric acid ($H_3PO_4$) | 1.0 g/L | ($PO_4^{-3}$ ions: 0.7 g/L) |
| Polymer 6 (see below) | 2.0 g/L | (solids) |

pH: 3.0 (adjusted with sulfuric acid)

Balance: water

Polymer 6: according to formula I when n=5, X=hydrogen, $Y^1$=—$SO_3Na$≠Z, and the average value for Y group substitution=0.25.

COMPARATIVE EXAMPLE 6

Cleaned stainless steel sheet was immersed for 2 seconds in surface treatment bath 13 with components given below, heated to 60° C., and then dried for 2 minutes in a hot air drying oven at 80° C. The treated sheet was subsequently submitted to corrosion resistance tests A, B, and C, paint adherence test A, and lubrication tests A and B.

Surface Treatment Bath 13

| | | |
|---|---|---|
| 75% Phosphoric acid ($H_3PO_4$) | 0.2 g/L | ($PO_4^{-3}$ ions: 0.15 g/L) |

pH: 5.0 (adjusted with sodium hydroxide)

Balance: water

COMPARATIVE EXAMPLE 7

Cleaned stainless steel sheet was immersed for 2 seconds in surface treatment bath 14 with components given below, heated to 60° C., and then dried for 2 minutes in a hot air drying oven at 80° C. The treated sheet was subsequently submitted to corrosion resistance tests A, B, and C, paint adherence test A, and lubrication tests A and B.

Surface Treatment Bath 14

| | | |
|---|---|---|
| 75% Phosphoric acid ($H_3PO_4$) | 10.0 g/L | ($PO_4^{-3}$ ions: 7.2 g/L) |
| Polymer 7 (see below) | 1.0 g/L | (solids) |

pH: 8.0 (adjusted with sodium carbonate)

Balance: water.

Polymer 7: polymer with formula (VI) below, described in Japanese Patent Application Laid Open [Kokai or Unexamined] Number Hei 1-177206):

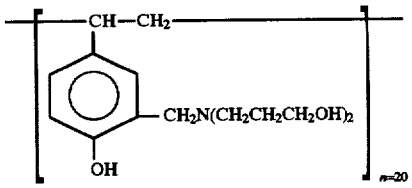

(VI)

Test results for all the Examples and Comparison Examples are shown in Table 1. As these results make clear, coatings with an excellent corrosion resistance, excellent adherence, and excellent lubrication were obtained in Examples 1 to 8, in which the surface treatments were executed by methods according to the present invention using surface treatment polymer compositions according to the present invention. In contrast to this, satisfactory values could not be simultaneously obtained for all these properties (corrosion resistance, paint adherence, and lubrication) in the case of the coatings afforded by surface treatment baths outside the scope of the present invention (Comparative Examples 1 to 7).

As the preceding description has made clear, a highly corrosion-resistant, paint-adherent, and lubricating coating can be produced on the surface of metals, prior to the painting or working thereof, by application of the treatment method according to the present invention using the surface treatment polymer composition according to the present invention. The method and composition according to the present invention are therefore highly effective for practical applications.

TABLE 1

| | Corrosion Resistance in Test: | | | Paint Adherence in Test: | | Lubrication Results | |
|---|---|---|---|---|---|---|---|
| Number | A | B | C | A | kgf/5 mm | μ | # of Slides |
| E 1 | Ex. | — | — | Ex. | — | 1.0 | — |
| E 2 | Ex. | — | — | Ex. | — | 1.0 | — |
| E 3 | Ex. | Ex. | — | Ex. | — | 0.9 | — |
| E 4 | Ex. | Ex. | — | Ex. | — | 0.9 | — |
| E 5 | Ex. | Ex. | Ex. | Ex. | 4.5 | 1.0 | — |
| E 6 | Ex. | Ex. | Ex. | Ex. | 4.2 | 1.0 | — |
| E 7 | Ex. | Ex. | Ex. | Ex. | — | 0.8 | 200 |
| E 8 | Ex. | Ex. | Ex. | Ex. | — | 0.8 | 180 |
| CE 1 | Poor | — | — | Poor | — | 1.3 | — |
| CE 2 | Ex. | Poor | — | Poor | — | 1.1 | — |
| CE 3 | Ex. | Ex. | — | Poor | — | 1.1 | — |
| CE 4 | Ex. | Ex. | Poor | Poor | 2.0 | 1.6 | — |
| CE 5 | Ex. | Ex. | Poor | Poor | 2.0 | 1.6 | — |
| CE 6 | Ex. | Ex. | Ex. | Poor | — | 1.1 | 30 |
| CE 7 | Ex. | Ex. | Ex. | Poor | — | 1.1 | 40 |

Abbreviations for Table 1
E = Example; CE = Comparative Example; μ = Coefficient of Static Friction; Ex. = Excellent

The invention claimed is:

1. A method for treating a metal surface by contacting the metal surface with an aqueous liquid composition having a pH from 2.0 to 6.5 and comprising water, at least one acidic compound, and from 0.01 to 20 g/L of polymer molecules conforming to the following general formula (I):

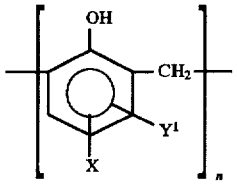

(I)

in which (i) the X bonded to the phenyl dng in formula (I) represents (i.1) a hydrogen atom. (i.2) a hydroxyl group, (i.3) a $C_1$ to $C_5$ alkl group, (i.4) a $C_1$ to $C_5$ hydroxyalkyl group, (i.5) a $C_6$ to $C_{12}$ aryl group, (i.6) a benzil group, (i.7) benzal group, (i.8) an unsaturated hydrocarbon moiety condensed to the phenyl ring so as to form a naphthalene ring, or (i.9) a group conforming to the following general formula (II):

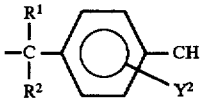

(II)

in which (i.9.1) each of $R^1$ and $R^2$ independently represents (i.9.1.1) a hydrogen atom, 0.9.1.2) a hydroxyl group, 0.9.1.3) a $C_1$ to $C_{10}$ alkyl group, or (i.9.4) a $C_1$ to $C_{10}$ hydroxyelkyl group; (ii) each of $Y^1$ anti $Y^2$ independently represents (ii.1) a hydrogen atom or (ii.2) a group Z conforming to one of the following formulas (III) and (IV):

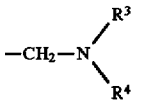

(III)

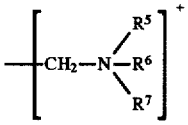

(IV)

in which each of $R^3$, $R^4$, $R^5$, $R^6$, and $R^7$ independently represents (ii.2.1) a $C_1$ to $C_{10}$ alkyl group or (ii.2.2) a $C_1$ to $C_{10}$ hydroxyalkyl group; (III) the X's in the polymer molecule may all be identical or may differ from one another, (iv) the $Y^{1}$'s and $Y^{2}$'s in the polymer molecule may all be identical or may differ from one another, (v) the average value for the number of Z groups substituted on each phenyl ring in said polymer molecule is 0.2 to 1.0; and (vi) n has a value of 2 to 50.

2. A method according to claim 1, wherein the aqueous liquid composition comprises from 0.1 to 30 g/L of phosphate ions.

3. A method according to claim 2, wherein the aqueous liquid composition comprises from 0.5 to 10 g/L of phosphate ions.

4. A method according to claim 3, wherein the aqueous liquid composition has a temperature in the range from 15° to 90° C. during contacting the metal surface.

5. A method according to claim 4, wherein the time of contacting the metal surface is not more than 60 seconds, and if the metal surface is rinsed after the period of contacting, the time of contacting is not less than 5 seconds.

6. A method according to claim 2, wherein the aqueous liquid composition has a temperature in the range from 15° to 90° C. during contacting the metal surface.

7. A method for treating a metal surface by contacting the metal surface with an aqueous liquid composition according to claim 1.

8. A method according to claim 7, wherein the aqueous liquid composition has a temperature in the range from 15° to 90° C. during contacting the metal surface, the time of contacting the metal surface is not more than 60 seconds, and if the metal surface is rinsed after the period of contacting, the time of contacting is not less than 5 seconds.

* * * * *